US005560595A

United States Patent [19]

Kulpa

[11] Patent Number: 5,560,595

[45] Date of Patent: Oct. 1, 1996

[54] ENVELOPE EJECTION SPEED CONTROL SYSTEM AND METHOD

[75] Inventor: Walter J. Kulpa, Trumbull, Conn.

[73] Assignee: Pitney Bowes Inc., Stamford, Conn.

[21] Appl. No.: 331,302

[22] Filed: Oct. 28, 1994

[51] Int. Cl.[6] ..... B65H 5/00

[52] U.S. Cl. ..... 271/2; 271/176; 271/182; 271/202; 271/203

[58] Field of Search ..... 271/2, 3.15, 3.14, 271/176, 182, 202, 203, 314, 270; 101/232, 233

[56] References Cited

U.S. PATENT DOCUMENTS

| | | | |
|---|---|---|---|
| 4,693,461 | 9/1987 | Takahashi | 271/176 |
| 4,787,311 | 11/1988 | Mol | 101/232 |
| 5,295,060 | 3/1994 | Eckert, Jr. et al. | 364/148 |
| 5,314,566 | 5/1994 | Gallagher et al. | 271/2 X |
| 5,332,210 | 7/1994 | Silverberg et al. | 271/220 |
| 5,337,248 | 8/1994 | Eckert, Jr. et al. | 364/468 |
| 5,369,424 | 11/1994 | Hori et al. | 271/182 X |

FOREIGN PATENT DOCUMENTS

| | | | |
|---|---|---|---|
| 62-244864 | 10/1987 | Japan | 271/176 |
| 8802734 | 4/1988 | WIPO | 271/2 |

*Primary Examiner*—David H. Bollinger
*Attorney, Agent, or Firm*—Angelo N. Chaclas; Melvin J. Scolnick

[57] ABSTRACT

A control system and method for ejecting an envelope having: a feeder for feeding the envelope out of the envelope handling device, a sensor for sensing the trailing edge of the envelope, and a microcontroller for controlling the feeder and in communication with the sensor the microcontroller causing the feeder to accelerate the envelope above a desired speed and decelerate the envelope after the sensor senses the trailing edge of the envelope so that the envelope is fed from the envelope handling device at the desired speed.

9 Claims, 10 Drawing Sheets

ENVELOPE EJECTION SPEED CONTROL SYSTEM AND METHOD

FIELD OF THE INVENTION

This invention is generally concerned with sheet feeding. More particularly, this invention is directed toward feeding an envelope out of an envelope handling device, such as: a mailing machine, a postage meter, an envelope printer or inserter.

BACKGROUND OF THE INVENTION

A typical envelope handling device includes an envelope feeding structure for feeding an envelope or a batch of envelopes in singular fashion in a downstream path of travel to a workstation. At the workstation a variety of operations can be performed on the envelope. For example, in a postage meter, a postal indicia is printed on the envelope. In other more generic printers, any desired image, barcode, address, etc., may be printed on the envelope. Another operation that can be performed is the insertion of documents into the envelope as in an inserter. After the operation is complete, the envelope is fed out of the workstation and ejected from the envelope handling device where it is collected in a drop stacker.

The purpose of the drop stacker is to collect and neatly stack the envelopes so that an operator may easily remove the envelopes from the drop stacker after processing a batch of envelopes. The drop stacker is generally used in low to medium volume operations. If a large volume of envelopes are being processed, then power stackers employing moving conveyor belts to carry away and collect the envelopes are typically used.

When processing a batch of envelopes, it is desirable to keep the envelopes separated. Specifically, the leading edge of an envelope should not run into the trailing edge of the previous envelope. Otherwise, misfeeds and jams occur which require operator intervention to correct. It is also desirable to achieve a high rate of throughput and thus process the batch of envelopes as quickly as possible. For these and other reasons, envelopes are typically fed out of the printing station faster than they are feed into the printing station. Thus ensuring that an incoming envelope will not collide with an exiting envelope.

Typical envelope handling devices employ ejection rollers or ejection belts operating at a constant speed. This constant speed is selected to be sufficiently high to avoid envelope collisions, but has been observed to cause other problems as discussed below.

The drop stacker includes an end wall, a registration wall and a stacking surface. The end wall is substantially vertical and generally perpendicular to the direction of envelope travel. It prevents the further downstream travel of the envelopes. The registration wall is substantially vertical and generally aligned to the direction of envelope travel. It serves to align the envelopes along their major length. The stacking surface is substantially horizontal and generally aligned below the exit plane of the thermal postage meter. It supports the envelopes as they accumulate in the drop stacker. As the envelope exits the thermal postage meter it continues on a slightly downward flight path, because of gravity, until it strikes the end wall at which point the envelope drops to the stacking surface. It has been observed that in typical ejection systems when the envelope strikes the end wall, the impact produces noise and also causes the envelope to bounce back away from the end wall. It has further been observed that the amount of noise and bounce back are proportional to the velocity of the envelope.

Both noise and bounce back are undesirable. Excessive noise tends to distract and irritate not only the machine operator but also others who are working in the surrounding area. Excessive bounce back prevents the envelopes from aligning neatly along their minor length. Therefore, there is a need to develop an ejection control system for an envelope handling device that reduces noise and bounce back in the drop stacker but still provides for high envelope throughput and avoids envelope collisions.

SUMMARY OF THE INVENTION

Accordingly, it is an object of the present invention to provide an ejection control system for an envelope handling device.

It is another object of the present invention to provide an ejection control system for an envelope handling device that reduces envelope noise in the drop stacker.

It is a further object of the present invention to provide an ejection control system for an envelope handling device that reduces envelope bounce back in the drop stacker.

It is still a further object of the present invention to provide an ejection control system for an envelope handling device that provides for increased throughput.

It is yet another object of the present invention to provide an ejection control system for an envelope handling device that avoids envelope collisions.

In accomplishing these and other objects there is provided a system and method for controlling ejection of an envelope from an envelope handling device.

The control system comprises: first means for feeding the envelope out of the envelope handling device, second means for sensing the trailing edge of the envelope, and a microcontroller for controlling the first means and in communication with the second means, the microprocessor programmed to cause the first means to accelerate the envelope above a desired speed and decelerate the envelope after the second means senses the trailing edge of the envelope so that the envelope is fed from the envelope handling device at the desired speed.

The method comprises the steps of: (a) accelerating said envelope above a desired speed, (b) detecting said trailing edge of said envelope, (c) decelerating said envelope, and (d) ejecting said envelope at said desired speed.

Therefore, it is now apparent that the invention substantially achieves all the above objects and advantages. Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENTS

While the disclosed system and method for controlling ejection of an envelope from an envelope handling device is given with respect to a thermal postage meter, it will be apparent to those skilled in the art that the present invention has similar application in other envelope handling devices.

Figure 1:
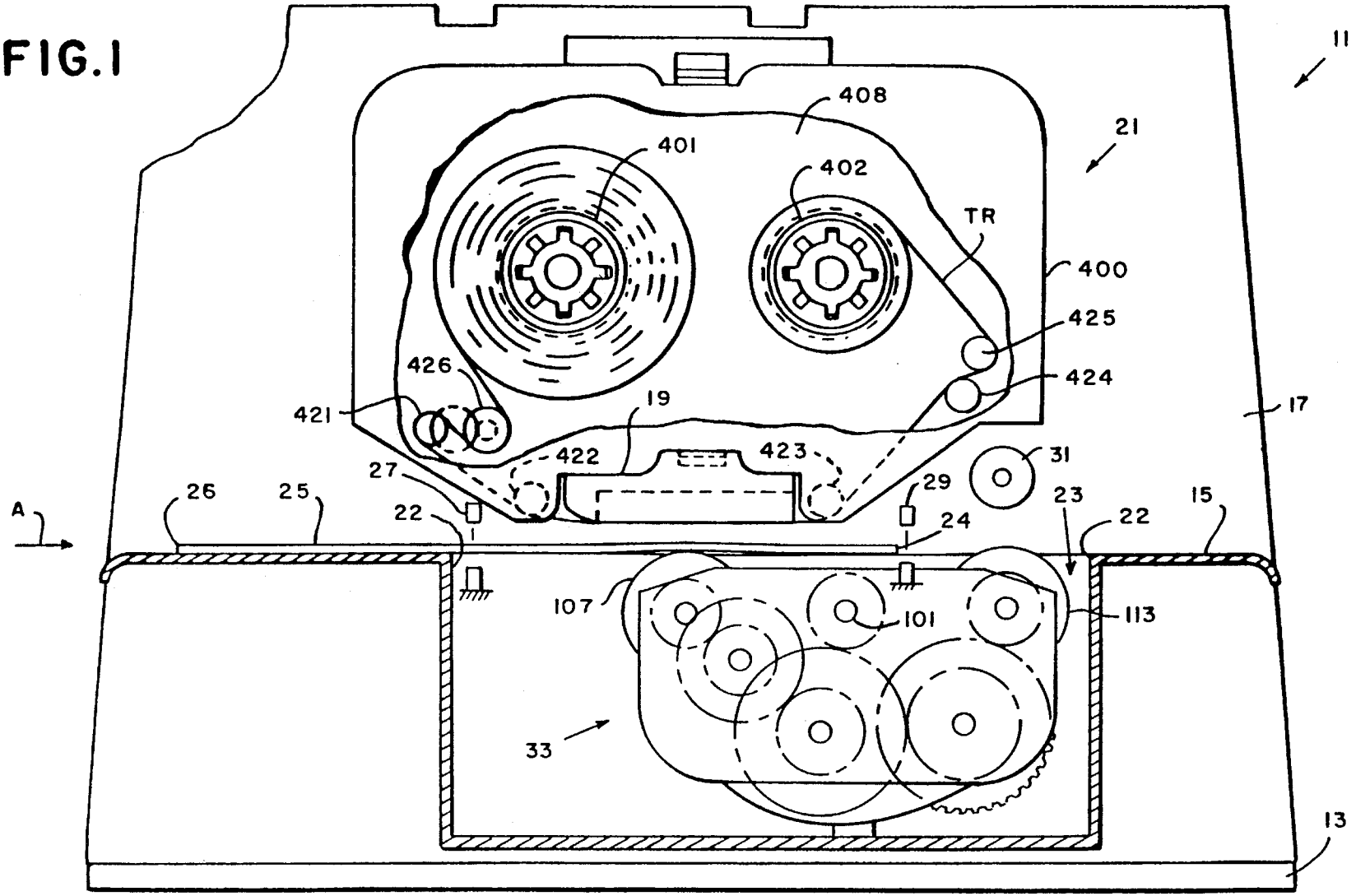
FIG. 1 a partial cutaway and partial sectioned front view of a thermal postage meter with a ribbon cassette.

Referring to FIG. 1, a thermal postage meter 11 constructed in accordance with this invention is shown. Included in the meter 11 is a base 13 and a substantially vertical registration wall 17. The registration wall 17 and the base 13 are rigid structures each providing suitable framework for mounting and supporting various other components. Fixably mounted to the registration wall 17 and the base 13 is a substantially horizontal deck 15. A thermal print head 19, a trailing edge sensor 27 and a leading edge sensor 29 are fixably mounted to the registration wall 17.

Detachably mounted to the registration wall 17 is a thermal ribbon cassette 21 containing a supply of thermal ribbon TR which has a backing layer and an ink coating layer. The thermal ribbon TR is unwound from a supply reel 401 and feed along a defined path such that the backing layer comes into contact with the thermal print head 19 before being collected on a take-up reel 402.

Rotatively mounted to the registration wall 17 is a backing roller 31. An envelope 25 having a leading edge 24 and a trailing edge 26 is shown positioned on the deck 15 and travels along a defined path from left to right as indicated by arrow "A." The deck 15 includes an opening 22 and deck recess 23 which are generally aligned underneath the thermal print head 19 and the backing roller 31.

A print and eject roller drive assembly 33 is generally located in the deck recess 23 such that a print roller 107 is opposite the thermal print head 19 and an eject roller 113 is opposite the backing roller 31. The axes of the print roller 107 and eject roller 113 are substantially parallel and transverse to the direction of envelope travel "A." The deck recess 23 being sufficiently large to accommodate the drive assembly 33. The nip between the print roller 107 and the thermal print head 19 is commonly referred to as a workstation or print station where actual printing of a postal indicia on the envelope 25 occurs. The nip between the ejection roller 113 and the backing roller 31 is commonly referred to as the exit of the thermal meter 11. The eject roller 113 is located downstream from the print head 19.

Figure 1A:
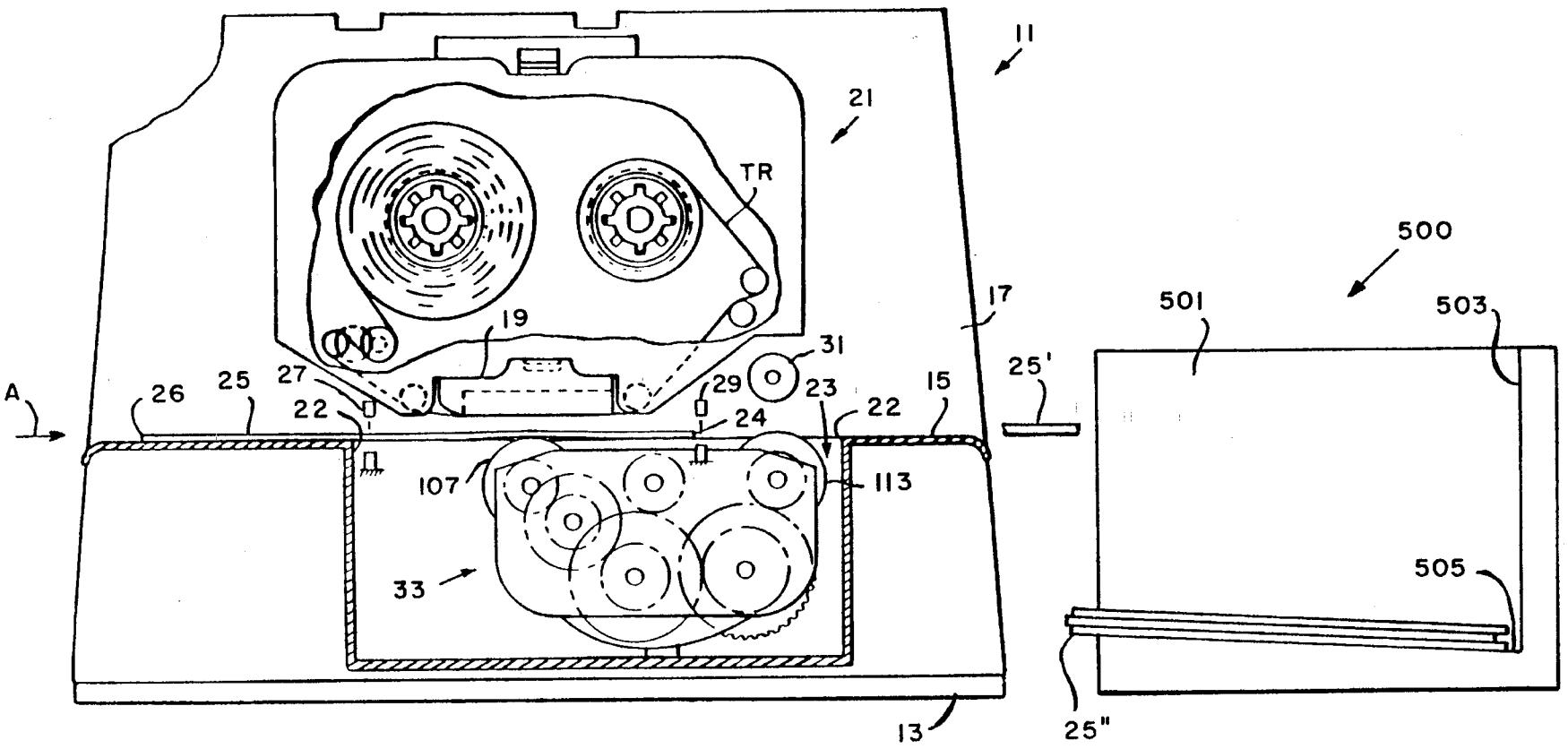
FIG. 1A is the thermal postage meter as in FIG. 1 in combination with a drop stacker.

Referring to FIG. 1A, the thermal postage meter 11 is shown in combination with a drop stacker 500. The drop stacker 500 serves to collect and neatly stack envelopes 25 as they are fed out of the thermal meter 11. An envelope 25' is shown exiting the thermal meter 11. A batch of envelopes 25" is shown already collected in the drop stacker. The drop stacker includes: (1) an end wall 503, (2) a registration wall 501, (3) and a stacking surface 505. The end wall 501 is substantially vertical and generally perpendicular to the direction of envelope travel "A" so as to prevent further downstream travel of the envelopes 25. The registration wall 501 is substantially vertical and generally aligned to the direction of envelope travel "A" and serves to align the envelopes along their major length. The stacking surface 505 is substantially horizontal and generally aligned below the exit plane, deck 15, of the thermal meter 11 and supports the envelopes 25" as they accumulate in the drop stacker 500.

Figure 2:
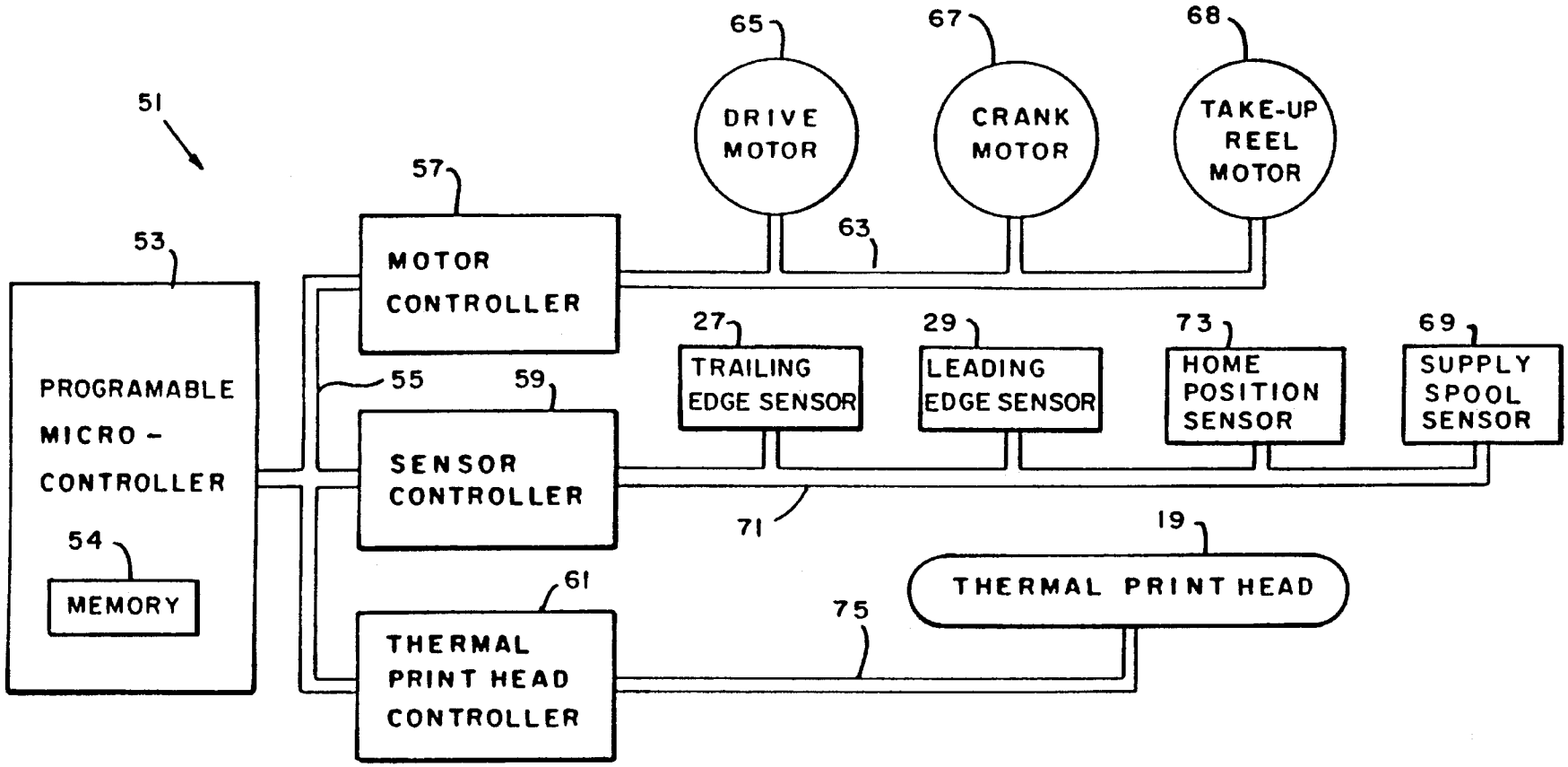
FIG. 2 is a schematic of a microcontroller.

Referring to FIGS. 1 and 2, the thermal meter 11 is under the influence of a control system 51. The control system 51 includes a programmable microcontroller 53 of any suitable conventional design, which is in bus 55 communication with: a motor controller 57, a sensor controller 59 and a thermal print head controller 61. The microcontroller 53 includes memory 54. The motor controller 57, sensor controller 59, and thermal print head controller 61 are of any suitable conventional design. The motor controller 57 is in motor bus 63 communication with: a drive motor 65, a crank motor 67 and a take-up reel motor 68. The drive motor 65 and crank motor 67 are suitably designed stepper motors. The sensor controller 59 is in sensor bus 71 communication with: the trailing edge sensor 27, the leading edge sensor 29, a home position sensor 73, and a supply reel sensor 69. The thermal print head controller 61 is in thermal print head bus 75 communication with the thermal print head 19. The trailing edge sensor 27, leading edge sensor 29, home position sensor 73 and supply reel sensor 69 are suitably designed optical sensors. The trailing edge sensor 27 is located a known distance upstream from the ejection roller 113.

Figure 3:
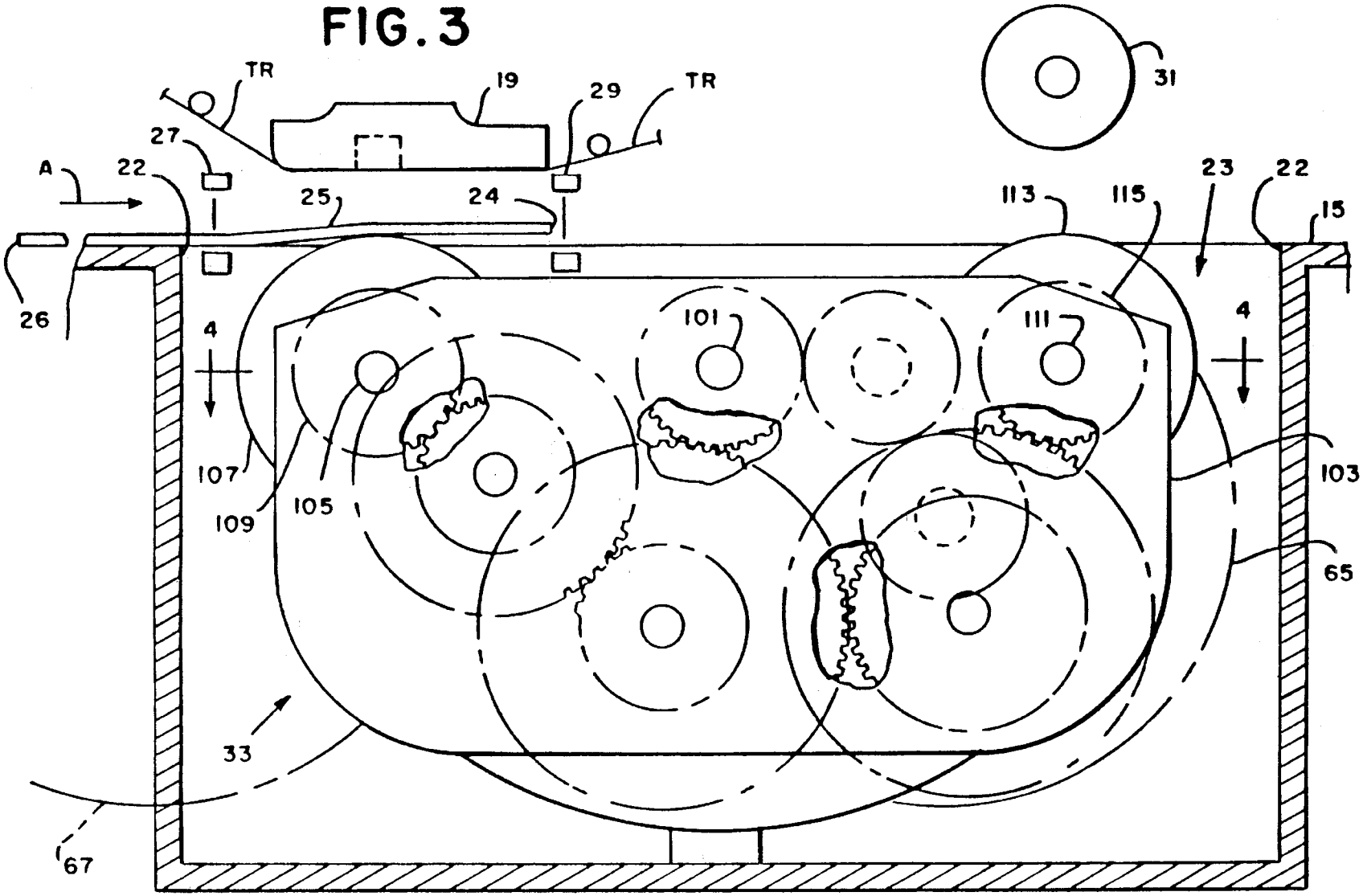
FIG. 3 is a sectioned front view of the drive assembly in the home position.

Referring to FIGS. 2 and 3, the leading edge sensor 29 and the trailing edge sensor 27 are suitably positioned relative to the deck 15 so as to detect the presence Of the envelope 25. The leading edge sensor 29 is positioned downstream in the direction of envelope travel "A" from the print roller 107 but upstream from the drive shaft 101. The leading edge sensor 29 indicates to the microcontroller 53 the presence of the envelope 25 when a leading edge 24 of the envelope 25 blocks the leading edge sensor 29. The trailing edge sensor 27 is positioned upstream from the print roller 107. The trailing edge sensor 27 indicates to the microcontroller 53 when a trailing edge 26 of the envelope 25 is detected.

Referring to FIG. 3, the drive assembly 33 includes a drive shaft 101 which is rotatively mounted to extend between the registration wall 17 and deck recess 23. The drive shaft 101 is located below and parallel to the deck 15. Additionally, the drive shaft 101 is aligned to be transverse to the direction of envelope travel "A." Rotatively mounted to the drive shaft 101 is a drive housing 103 which is a generally U-shaped bracket with suitable framework for attaching various shafts, springs and gears. The deck recess 23 is sufficiently large and free from obstructions to allow the drive housing 103 to rotate or pivot freely about the drive shaft 101. Rotatively mounted to the drive housing 103 is a print roller shaft 105 and an eject roller shaft 111. Fixably mounted to the print roller shaft 105 is the print roller 107 and a print roller gear 109. Fixably mounted to the eject roller shaft 111 is the eject roller 113 and an eject roller gear 115. The print roller 107 and the eject roller 113 are positioned symmetrically about a vertical center line passing through the center of the drive shaft 101. Additionally, the drive shaft 101, the print roller shaft 105 and the eject roller shaft 111 are substantially in horizontal alignment. It should now be apparent that drive housing 103 behaves in a seesaw like fashion pivoting about the drive shaft 101 with the print roller 107 on one end of the drive housing 103 and the eject roller 113 on the other end of the drive housing 103. The drive motor 65 is connected to the print roller 107 and the eject roller 113 by a print roller gear train and an eject roller gear train, respectively. Thus, the drive motor 65 rotates both the print roller 107 and the eject roller 113.

Figure 4:
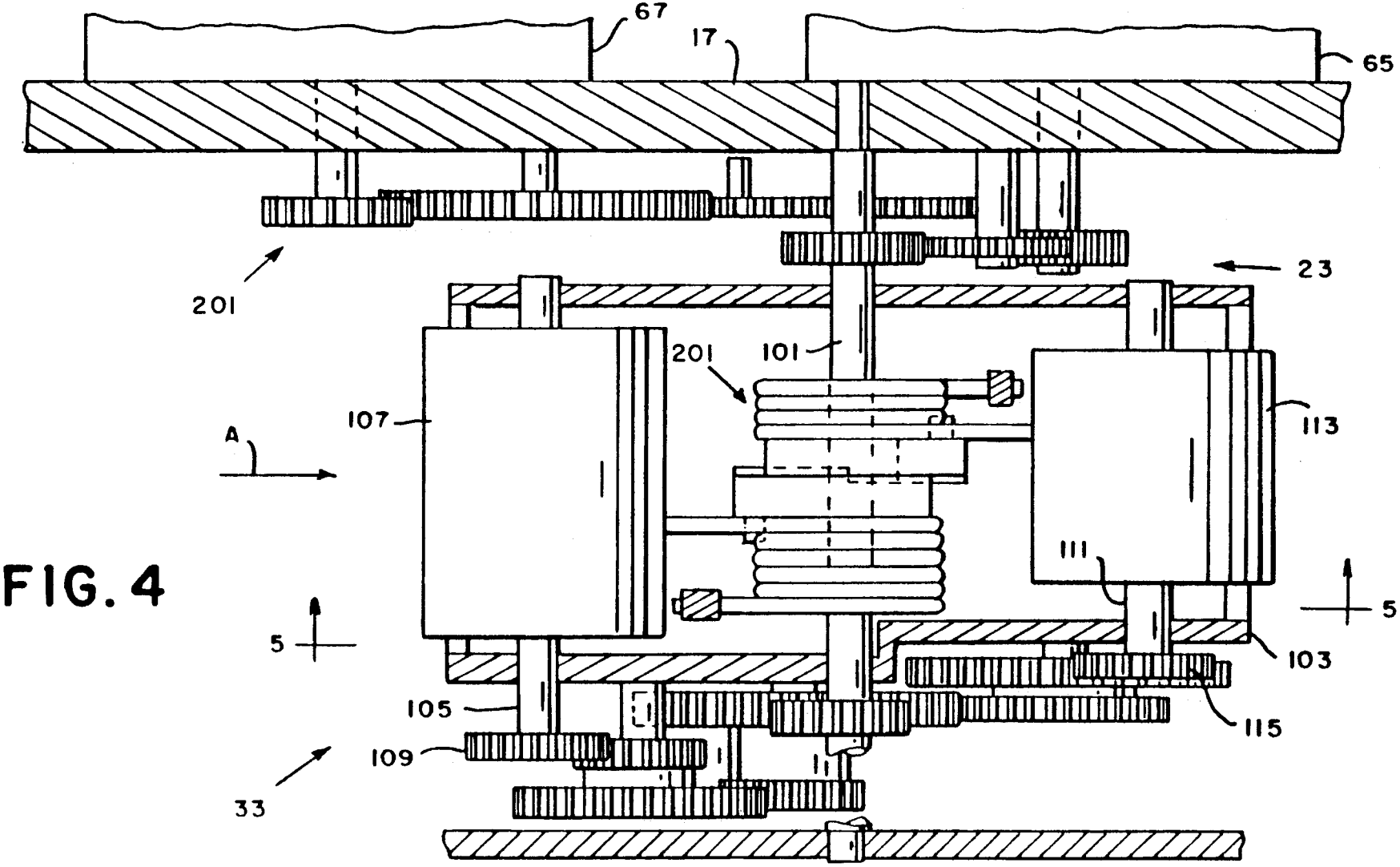
FIG. 4 is a sectioned plan view of the drive assembly taken substantially along 4—4 as shown in FIG. 3.

Referring to FIG. 4, the drive assembly 33 and a crank assembly 201 are shown. The crank assembly 201 is generally located in the deck recess 23 and below the drive assembly 33. The crank assembly 201 is under the control of microcontroller 53 and is primarily responsible from repositioning the drive housing 103 between the home, print and eject positions. A detailed description of the drive assembly 33 and crank assembly 201 is contained in U.S. patent application Ser. No. 08/331,304, filed on Oct. 28, 1994, U.S. Pat. No. 5,521,627, assigned to the assignee of the present invention and incorporated herein by reference.

Referring to FIGS. 2, 5A, 5B, and 5C, the function of the thermal postage meter 11 is to accept the envelope 25, print a postal indicia using thermal transfer print technology, and eject the envelope 25 from the meter 11. The feed direction of the meter 11 is from left to right and is indicated by arrow "A". The envelope 25 and thermal ribbon TR are pinched between the print roller 107 and the thermal print head 19. The print roller 107 supplies the thermal print head 19 sufficient backing pressure needed for transfer of ink from a thermal ribbon TR to the envelope 25 during the print cycle. Due to frictional forces, rotation of the print roller 107 causes the envelope 25 and the thermal ribbon TR to feed together at a constant rate past the thermal print head 19. The programmable microcontroller 53 is programmed to instruct the thermal print head controller 61 to actuate the heating elements of the thermal print head 19 synchronous to displacement of the envelope 25 to produce the postal indicia or other desired image. Since the print roller 107 feeds both the envelope 25 and thermal ribbon TR, use of the print roller 107 to feed the envelope 25 from the postage meter 11 would lead to wasted thermal ribbon TR. To conserve thermal ribbon TR, the eject roller 113 is used to feed the envelope 25 out of the postage meter 11 after printing.

Figure 5A:
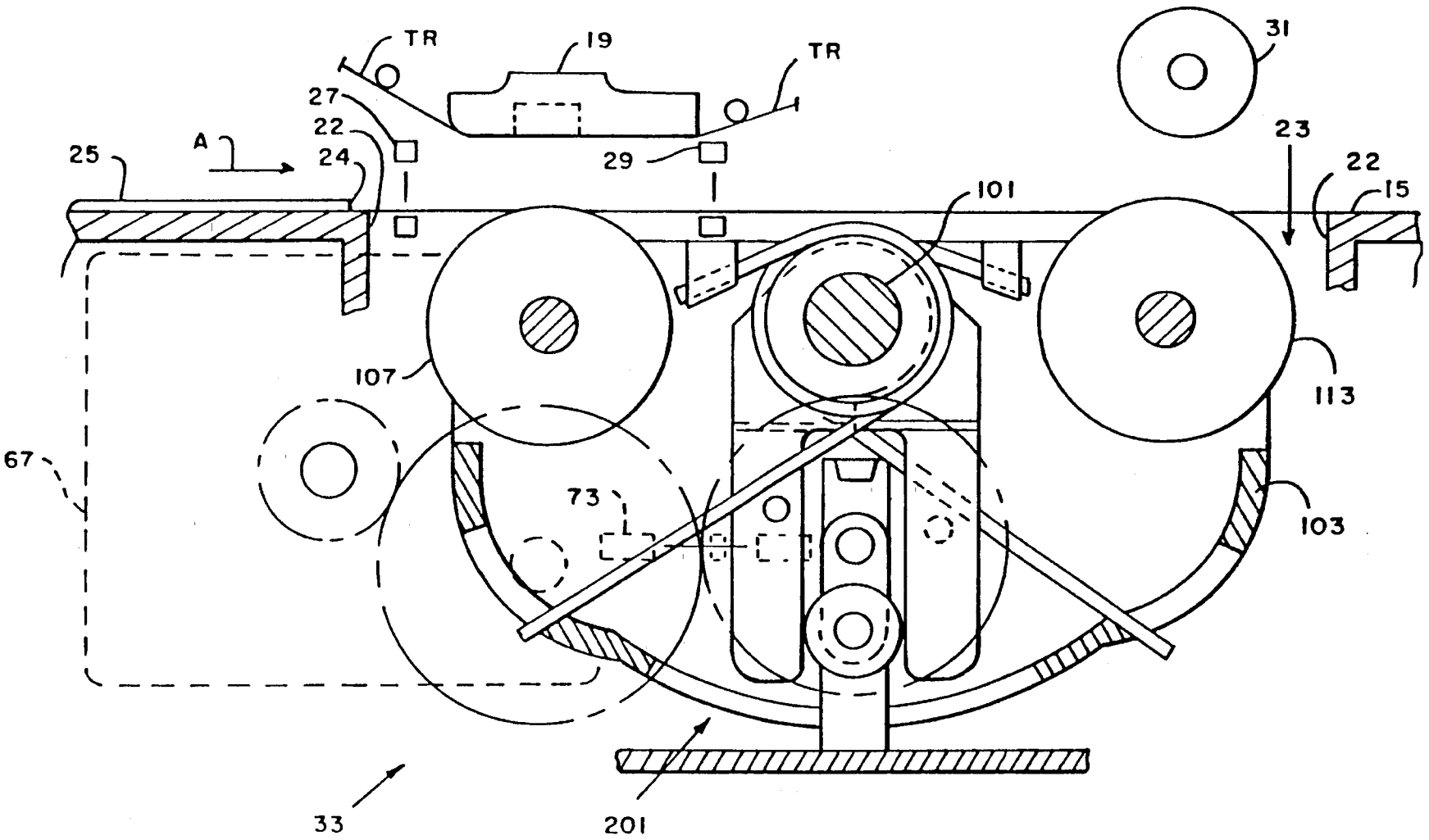
FIG. 5A is a sectioned front view of the drive assembly and crank assembly in the home position taken substantially along 5—5 as shown in FIG. 4.

Referring to FIG. 5A, the drive assembly 33 and the crank assembly 201 are in the home position. The print roller 107 and the eject roller 113 are provided for independent control of the envelope 25. The print roller 107 and eject roller 113 are mounted on opposite sides of the drive housing 103 which pivots about the drive shaft 101. When the drive assembly 33 is in the home position, the print roller 107 is spaced apart from the thermal print head 19 and the eject roller 113 is spaced apart from the backing roller 31. It should be apparent that the feed path of the thermal ribbon TR is defined so that the thermal ribbon TR contacts the thermal print head 19 but not the backing roller 31.

Figure 5B:
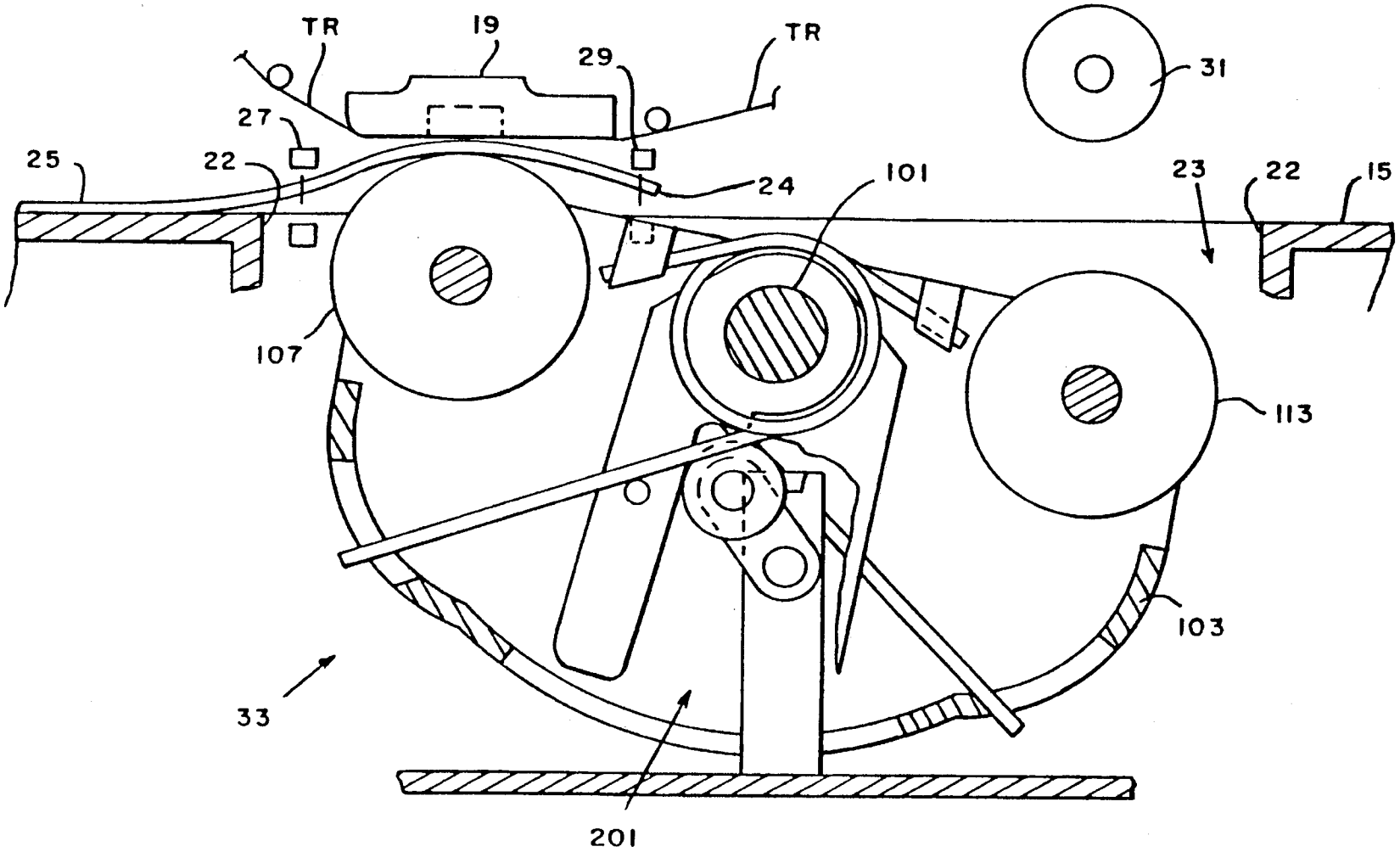
FIG. 5B is a sectioned front as in FIG. 5A of the drive assembly and the crank assembly in the print position with the eject lever partially broken away for clarity.

Referring to FIG. 5B, the drive assembly 33 and the crank assembly 201 are in the print position. If the drive housing 103 pivots about the drive shaft 101 in a clockwise direction from the home position, then the print roller 107 pivots up above the deck 15 to bring the envelope 25 in contact with the thermal ribbon TR and the thermal print head 19. It should be readily apparent that the deck 15 is provided with suitable located openings to accommodate the motion of the drive housing 103 and print roller 107.

Figure 5C:
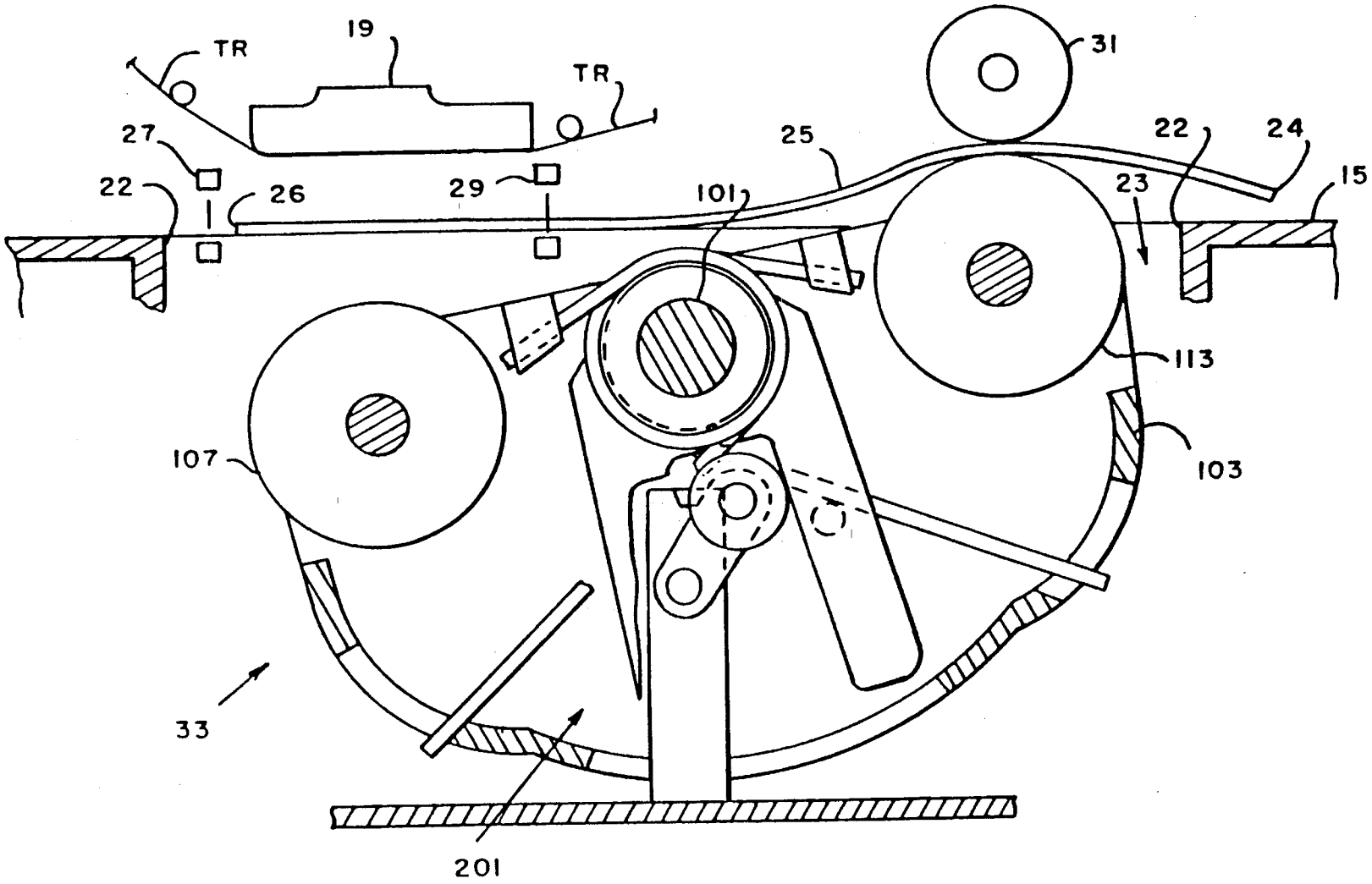
FIG. 5C is a sectioned front as in FIG. 5A of the drive assembly and the crank assembly in the eject position with the eject lever partially broken away for clarity.

Referring to FIG. 5C, the drive assembly 33 and the crank assembly 201 are in the eject position. If the drive housing 103 pivots about the drive shaft 101 in a counter clockwise direction from the home position, then the eject roller 113 pivots up above the deck 15 to bring the envelope 25 in contact with the backing roller 31. It should be readily apparent that the deck 15 is provided with suitable located openings to accommodate the motion of the drive housing 103 and eject roller 113.

The thermal postage meter 11 remains at idle with the drive assembly 33 and the crank assembly 201 in the home position until the operator or envelope feed system advances the envelope 25 sufficiently along the deck 15 so that the leading edge 24 of envelope 25 is detected by the leading edge sensor 29. Once the leading edge 24 of the envelope 25 is detected, the programmable microcontroller 53 initiates a print cycle. The crank assembly 201 rotates the drive housing 103 into the print position where the print roller 107 advances the envelope 25 past the print head 19. As the envelope 25 advances past the print head 19, the microcontroller 53 selectively energizes individual heating element located in the thermal print head 19 to create a desired image (postal indicia, address, etc.) on the envelope 25. The energized heating elements melt the ink on the thermal ribbon TR which transfers to the envelope 25 before it resolidifies. After printing is completed, the microcontroller 53 stops the drive motor 65 from rotating and instructs the crank motor 67 to reposition the drive housing 103 from the print position to the eject position. While the drive housing 103 is being repositioned, the envelope 25 remains stationary on the deck 15 in the print station. As the drive housing 103 enters the eject position, the ejection roller 113 compresses the envelope 25 against the backing roller 31. Then the microcontroller 53 instructs the drive motor 65 to rotate which in turn causes the eject roller 113 to rotate and thus feed the envelope 25 out of the thermal meter 11. The microcontroller 53 may employ different speed versus time profiles to feed the envelope 25 out of the thermal meter 11.

Figure 6:
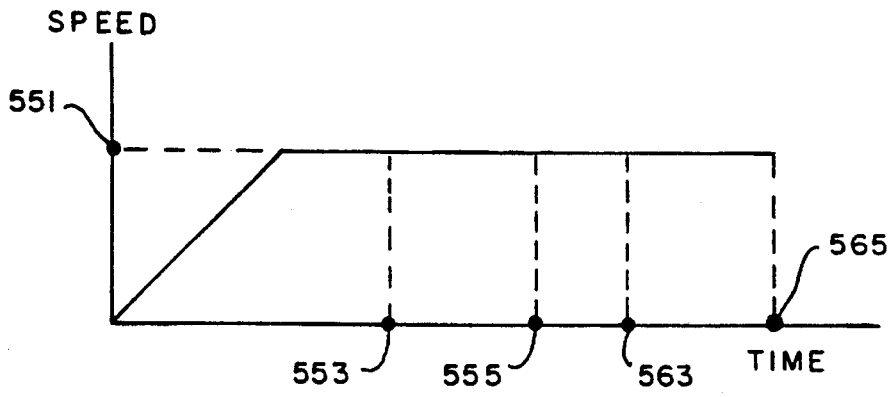
FIG. 6 is a diagram of an envelope ejection speed versus time profile for short and long envelopes where the envelopes are initially accelerated and then held at a constant speed.

Referring to FIG. 6, a typical speed versus time profile is shown for two types of envelopes 25, a short envelope and a long envelope (the terms "short" and "long" as used here are relative terms as measured along the major length of the envelope 25). In each case, the envelope 25 is accelerated from a stationary position up to a constant speed 551 and then maintained at that constant speed 551 until fed out of the thermal meter 11. The trailing edge 26 of a short envelope is detected at 553 and ejected at 563. The trailing edge 26 of a long envelope is detected at 555 and ejected at 565. Such systems suffer from the problems and disadvantages as discussed above.

Figure 7A:
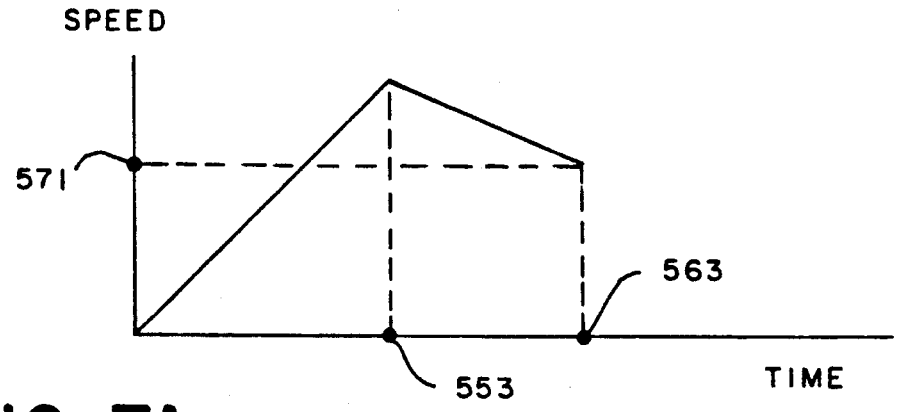
FIG. 7A is a diagram of an envelope ejection speed versus time profile where a short envelope is continuously accelerated until the trailing edge of the short envelope is detected and then decelerated at a calculated rate.
Figure 7B:
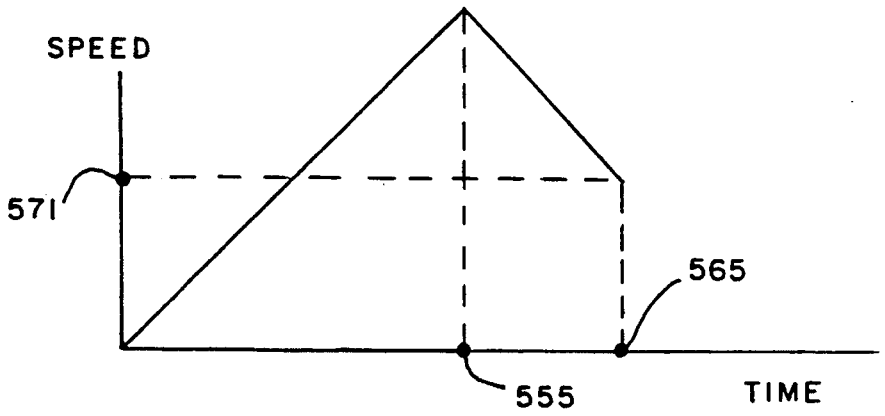
FIG. 7B is a diagram of an envelope ejection speed versus time profile where a long envelope is continuously accelerated until the trailing edge of the long envelope is detected and then decelerated at a calculated rate.

Referring to FIGS. 7A and 7B, a speed versus time profile is shown as employed in a first embodiment of an envelope ejection speed control system. FIG. 7A shows a short envelope profile while FIG. 7B shows a long envelope profile. The envelope 25, is accelerated until the trailing edge sensor 27 senses or detects the trailing edge 26 of the envelope 25. Therefore, the length of the envelope 25 is a factor that determines a peak speed of the envelope 25 which is achieved simultaneous with the trailing edge sensor 27 detecting the trailing edge 26 of the envelope 25. At this point, the microcontroller 53 (or other suitable control circuitry), using the peak speed and the known distance from the trailing edge sensor 27 to the ejection roller 113, calculates a corresponding constant deceleration so that as the trailing edge 26 of the envelope 25 exits the thermal meter 11 the envelope 25 is at a desired speed 571. It is important that the desired speed 571 be selected so as to: (1) avoid collisions, (2) ensure proper stacking, (3) reduce unwanted bounce back, and (4) reduce unwanted noise. It has been empirically determined, that a suitable range for the desired speed 571 is between 30 and 35 inches per second. Those skilled in the art will recognize that the desired speed 571 is influenced by other factors such as envelope weight and the exact stacker configuration being used. It should now be apparent, that for each envelope 25 having a different length a respective peak speed and corresponding constant deceleration will result. The trailing edge 26 of a short envelope is detected at 553 and ejected at 563. The trailing edge 26 of a long envelope is detected at 555 and ejected at 565.

Figure 8A:
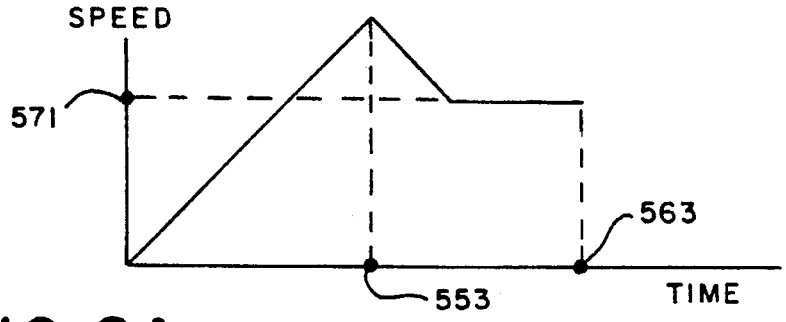
FIG. 8A is a diagram of an envelope ejection speed versus time profile where a short envelope is continuously accelerated until the trailing edge of the short envelope is detected and then decelerated at a fixed rate.
Figure 8B:
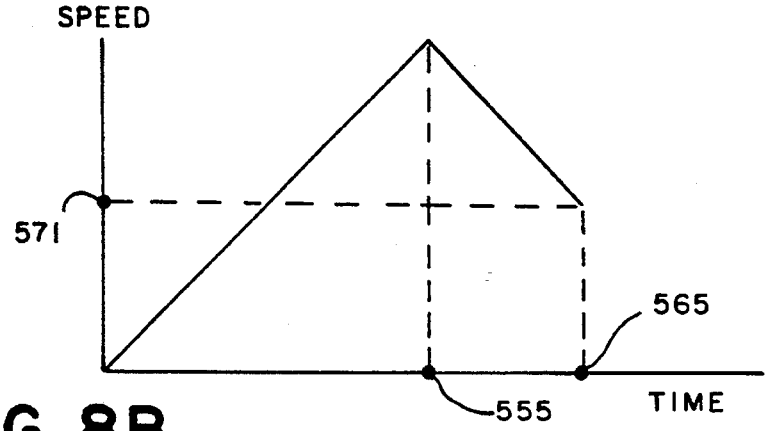
FIG. 8B is a diagram of an envelope ejection speed versus time profile where a long envelope is continuously accelerated until the trailing edge of the long envelope is detected and then decelerated at a fixed rate.

Referring to FIGS. 8A and 8B, a speed versus time profile is shown as employed in a second embodiment of an envelope ejection speed control system. FIG. 8A shows a short envelope profile while FIG. 8B shows a long envelope profile. The envelope 25, is continuously accelerated until the trailing edge sensor 27 senses or detects the trailing edge 26 of the envelope 25. Therefore, as in the first embodiment, the length of the envelope 25 is a factor that determines a peak speed of the envelope 25 which is achieved simultaneous with the trailing edge sensor 27 detecting the trailing edge 26 of the envelope 25. However, in contrast to the first embodiment, a corresponding deceleration is not calculated. Instead, a fixed constant deceleration is used. Because no calculations are necessary, this embodiment is more simple to implement but does not achieve as high a throughput as the first embodiment. Since the deceleration is fixed, not varying between different length envelopes 25, then the deceleration must be selected to accommodate for: (1) the envelope 25 of greatest major length specified for use in the thermal meter 11, or (2) some other selected envelope length. The fixed deceleration is calculated using the technique described in the first embodiment. This will ensure that the selected envelope 25 exits the thermal meter 11 at the desired speed 571. For shorter envelopes, the same fixed deceleration is used but once the desired speed 571 is reached, no further deceleration occurs and the envelope 25 is held at the desired speed 571 until ejected. Since this deceleration does not vary, it can be stored in the microcontroller 53 or other suitable location and does not need to be calculated for each envelope 25. The trailing edge 26 of a short envelope is detected at 553 and ejected at 563. The trailing edge 26 of a long envelope is detected at 555 and ejected at 565.

Figure 9A:
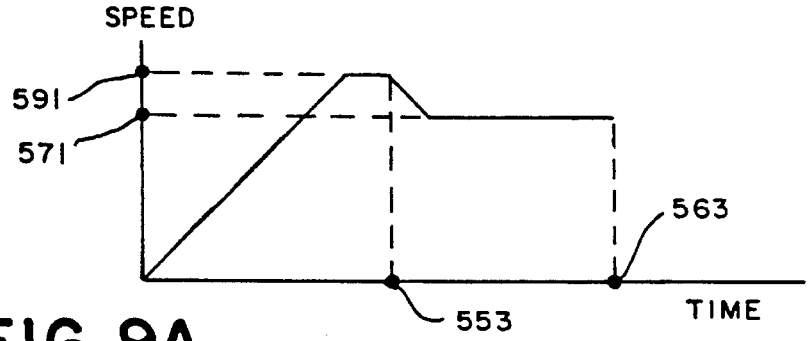
FIG. 9A is a diagram of an envelope ejection speed versus time profile where a short envelope is continuously accelerated until a limiting speed is reached and then when the trailing edge of the short envelope is detected the short envelope is decelerated at a fixed rate.
Figure 9B:
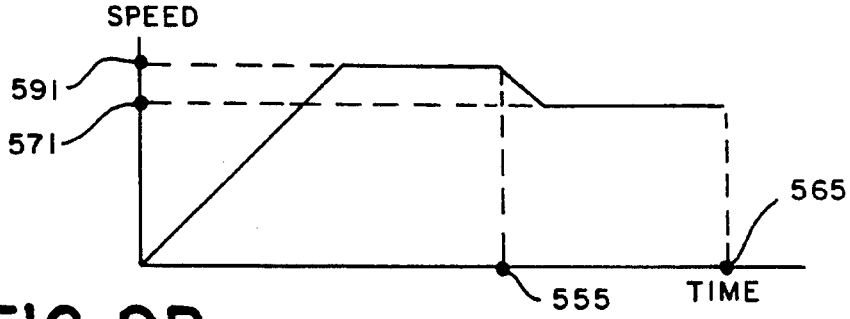
FIG. 9B is a diagram of an envelope ejection speed versus time profile where a long envelope is continuously accelerated until a limiting speed is reached and then when the trailing edge of the long envelope is detected the long envelope is decelerated at a fixed rate.

Referring to FIGS. 9A and 9B, a speed versus time profile is shown as employed in a third embodiment of an envelope ejection speed control system. FIG. 9A shows a short envelope profile while FIG. 9B shows a long envelope profile. The envelope 25, is continuously accelerated until an ejection speed limit or limiting speed 591 is reached and then held at this speed until the trailing edge sensor 27 senses or detects the trailing edge 26 of the envelope 25. At this point, either the deceleration scheme of the first embodiment or the second embodiment may be utilized. In FIGS. 9A and 9B, the deceleration scheme of the second embodiment is shown. It should be apparent that the third embodiment is suited to those applications where the peak speed should remain below a selected ejection speed limit 591 to prevent an undesirable occurrence, such as: drive motor 65 failure, heat build up, envelope 25 tearing or excessive noise. The ejection speed limit 591 is selected to be higher than the desired ejection 571 speed but so high so as to cause other problems. Although this embodiment does not provide as high a throughput as the first embodiment or the second embodiment, it is straight forward to implement and avoids the potential risk of one of the undesirable occurrences. The trailing edge 26 of a short envelope is detected at 553 and ejected at 563. The trailing edge 26 of a long envelope is detected at 555 and ejected at 565.

Those skilled in the art will now recognize that in each embodiment the throughput of the thermal meter 11 has been increased by ejecting the envelope 25 quicker than in the typical system as shown in FIG. 6 while decreasing noise and bounce back in the drop stacker 500.

Those skilled in the art will also recognize that because the speed versus time profiles shown in FIGS. 6, 7A, 7B, 8A, 8B, 9A and 9B contain only linear segments, then the resulting decelerations must all be constant. In the first embodiment, the calculated decelerations are all constant, but vary depending on the length of the envelope 25. In the second embodiment, the deceleration is not only constant but fixed so as to accommodate the envelope 25 of greatest length. Here, the deceleration does not vary on the length of the envelope 25.

However, it should be apparent that the acceleration and deceleration do not have to be constant. The deceleration, as well as the acceleration, can be of any predetermined profile (constant, linear, conic, cycloidal, etc.) depending on the needs of the envelope handling device. For example, the acceleration and deceleration could be based on a cycloidal profile to reduce forces on the feeding system caused by rapid alterations in the rate change of speed.

Many features of the preferred embodiments represent design choices selected to best exploit the inventive concept for as implemented in a thermal postage meter. However, the present invention is applicable to other envelope handling devices as discussed above and may have other applications besides use with a drop stacker such as feeding an envelope to a subsequent workstation. Moreover, additional advantages and modifications will readily occur to those skilled in the art. Therefore, the invention in its broader aspects is not limited to the specific details of the preferred embodiments. Accordingly, various modifications and obvious substitutions may be made by those skilled in the art without departing from the spirit of the general inventive concept as defined by the appended claims and their equivalents.

What is claimed is:

1. A control system for ejecting an envelope having a trailing edge in a path of travel from an envelope handling device, said control system comprising:

first means for feeding said envelope out of said envelope handling device;

second means for sensing said trailing edge of said envelope; and a microcontroller for controlling said first means and in communication with said second means, said microcontroller causing said first means to accelerate said envelope above a desired speed and decelerate said envelope after said second means senses said trailing edge of said envelope so that said envelope is fed from said envelope handling device at said desired speed.

2. The control system of claim 1, wherein said second means includes a sensor located upstream in said path of travel a known distance from said first means.

3. The control system of claim 2, wherein said envelope achieves a peak speed defined when said sensor detects said trailing edge of said envelope, and said microcontroller determines a deceleration using said peak speed and said known distance.

4. The control system of claim 3 wherein said sensor is an optical sensor, said first means includes a roller and said envelope handling device is a postage meter.

5. The control system of claim 2, wherein said envelope achieves a peak speed defined when said sensor detects said trailing edge of said envelope, and said microcontroller controls said first means to decelerate said envelope at a fixed deceleration determined from said peak speed of a selected envelope having a known major length and said known distance.

6. The control system of claim 5 wherein said sensor is an optical sensor, said first means includes a roller and said envelope handling device is a postage meter.

7. The control system of claim 2, wherein said envelope is maintained by said microcontroller at a limit speed which is greater than said desired speed and said microcontroller controls said first means to decelerate said envelope at a fixed deceleration determined from said limit speed and said known distance.

8. The control system of claim 7 wherein said sensor is an optical sensor, said first means includes a roller and said envelope handling device is a postage meter.

9. A control system for ejecting an envelope having a trailing edge in a path of travel from a postage meter, said control system comprising:

a roller for feeding said envelope out of said postage meter;

an optical sensor located upstream in said path of travel a known distance from said roller to detect said trailing edge of said envelope;

a motor operatively connected to said roller for rotating said roller;

a microcontroller in communication with said optical sensor and said motor, said microcontroller for monitoring said optical sensor and controlling said motor, said microcontroller causing said motor to accelerate said envelope above a desired speed and thereafter decelerate said envelope when said optical sensor detects said trailing edge of said envelope so that said envelope is fed from said envelope handling device at said desired speed.

* * * * *